US006829464B2

(12) United States Patent
Haraguchi et al.

(10) Patent No.: US 6,829,464 B2
(45) Date of Patent: Dec. 7, 2004

(54) DEVELOPING APPARATUS

(75) Inventors: Manami Haraguchi, Kanagawa (JP); Kazuhisa Kemmochi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/434,057

(22) Filed: May 9, 2003

(65) Prior Publication Data

US 2003/0210931 A1 Nov. 13, 2003

(30) Foreign Application Priority Data

May 13, 2002 (JP) ..... 2002-137832

(51) Int. Cl.[7] ..... G03G 15/08
(52) U.S. Cl. ..... 399/281; 399/283
(58) Field of Search ..... 399/119, 149, 399/150, 281, 283, 287

(56) References Cited

U.S. PATENT DOCUMENTS 5,424,812 A 6/1995 Kemmochi et al. ..... 379/270
5,610,696 A 3/1997 Kemmochi et al. ..... 399/285
5,655,197 A * 8/1997 Okada et al. ..... 399/281
5,666,625 A * 9/1997 Komatsubara et al. ..... 399/281
5,895,151 A 4/1999 Kinoshita et al. ..... 399/284

FOREIGN PATENT DOCUMENTS

JP 10-48952 2/1998
JP 10153910 A * 6/1998 ..... G03G/15/08
JP 11-15246 1/1999

* cited by examiner

*Primary Examiner*—Arthur T. Grimley
*Assistant Examiner*—Ryan Gleitz
(74) *Attorney, Agent, or Firm*—Fitzpatrick, Cella, Harper & Scinto

(57) ABSTRACT

The developing apparatus includes a developer bearing member, a developer removing-feeding member and a circulating member, wherein the developer circulating member has a push-in amount to the removing-feeding member equal to or larger than a push-in amount of the developer circulating member to the developer removing-feeding member, thereby preventing toner fusion or generation of uncharged developer by a deterioration of the developer, and realizing stable development over a prolonged period.

11 Claims, 7 Drawing Sheets

DEVELOPING APPARATUS

BACKGROUND OF THE INVENTION

1. Field of the Invention

The present invention relates to a developing apparatus provided with a developer bearing member, and more particularly to a developing apparatus advantageously applicable to an image forming apparatus of an electrophotographic method or an electrostatic recording method such as a copying apparatus, a printer or the like.

2. Related Background Art

In an image forming apparatus such as a copying apparatus or a printer, an electrostatic latent image formed on an image bearing member such as an electrophotographic photosensitive member or an electrostatic recording dielectric member has been conventionally rendered visible with a powdered developer (toner).

As an example, there will be explained, with reference to FIG. 7, an image forming apparatus of reversal development type utilizing conventional non-magnetic one-component toner.

The image forming apparatus is constituted by an image bearing member (hereinafter referred to as photosensitive drum) for bearing an electrostatic latent image, rotated in a direction p, a charger 102, an exposure device 103 for forming an electrostatic latent image corresponding to image information on the photosensitive drum 101, a developing device (developing apparatus) 104, a transfer charger 105, a fixing device 106, a cleaner 107 etc.

The developing device 104 is provided with a developer bearing member 110 (hereinafter called developing roller), rotated in a direction q for conveying developer (hereinafter referred to as "toner") toward a contact portion with the photosensitive drum 101. The developing roller 110 is so-called elastic developing roller constituted by an elastic member formed on a conductive metal core, and is positioned in contact with the photosensitive drum 101. Around the developing roller 110, there are provided a removing-feeding roller 111 constituting a removing-feeding member rotated in a direction r, for feeding non-magnetic one-component toner onto the developing roller 110 and removing the toner from the developing roller 110, a regulating blade 112 constituting a regulating member for regulating the amount of the toner on the developing roller 110, and an agitating blade 113 constituting an agitating member for supplying the removing-feeding roller 111 with the toner. The removing-feeding roller 111 is constituted by a metal core shaft and a continuous cell foamed member formed thereon.

Referring to FIG. 7, the photosensitive drum 101 is rotated in a direction p, and the surface thereof is uniformly charged negatively by the charger (charging device) 102 to which a voltage is applied by an unrepresented bias source. Thereafter a laser beam from the exposure device 103 forms an electrostatic latent image on the photosensitive drum 101. Then, this electrostatic latent image is rendered visible as a toner image, by toner contained in the developing device 104 and conveyed by the developing roller 110 positioned in contact with the photosensitive drum 101. Thereafter, the toner image on the photosensitive drum 101 is transferred onto a transfer material 108 such as paper or an OHP sheet by a transfer charger 105, and is finally fused and fixed to the transfer material 108 by the fixing device 108.

Residual toner, remaining on the photosensitive drum 101 after the transfer, is removed from the photosensitive drum 101 by the cleaner 107.

Also the toner not used in the development at the contact portion between the photosensitive drum 101 and the developing roller 110 and remaining thereon is returned into the developing device 104 by the rotation of the developing roller 110. Then, at the contact portion between the developing roller 110 and the removing-feeding roller 111, the toner on the developing roller 110 is removed from the developing roller 110. At the same time, by the rotation of the removing roller 111, the toner is supplied onto the developing roller 110 and is conveyed again to a contact portion between the regulating blade 112 and the developing roller 110.

An image formation is achieved by the repetition of the above-described operations.

In recent years, energy saving and environmental issues are actively considered also in the image forming apparatus, and, as a part of such activities, there are being conceived toner fixable at a lower temperature than in the conventional toner, and toner incorporating fixing wax, for the purpose of dispensing with the fixing wax. However such toner, being designed to fuse at a lower temperature, is associated with a drawback of susceptible to friction and heat.

When such toner, fusing at a low temperature, was used in an image forming operation in a conventional developing apparatus, the toner was fused and fixed to the developing roller, the removing-feeding roller and the regulating blade whereby the toner could not be coated uniformly on the developing roller and a desired image could not be obtained.

Also in case of toner fusion to the developing roller or the regulating blade, there results a mutual frictional charging of the toner particles, whereby an appropriate charge cannot be provided to the toner. As a result, uncharged or deficiently charged toner is conveyed onto the developing roller and is deposited in a non-image area on the photosensitive drum, thereby causing an image defect, or is scattered onto the photosensitive drum or in the image forming apparatus, thereby causing a smear.

As a result of investigation by the present inventors for the cause of the above-mentioned drawback, there is identified, as a principal cause, a phenomenon that the toner removed from the developing roller by the removing-feeding roller is not discharged from the cells at the surface thereof but is directly conveyed again by the rotation of the removing-feeding roller to the contact portion with the developing roller, thereby causing a rapid deterioration of the toner.

Such deterioration of the toner principally means a deformation of the toner or a seeping out of the internal wax of the toner by such deformation. This is caused by accumulation of a frictional heat, generated by friction on the toner under a pressure in contact portions of various members, in the toner, thus leading to a softening of the toner. Thus, such toner softening occurs when the toner is subjected to frictions in succession in contact portions of the removing-feeding roller and the developing roller or of the developing roller and the regulating blade thereby receiving frictional heat in such contact portions in successive manner.

In case such toner softening and deformation by the frictional head proceed repeatedly, the toner is fused and sticks to the developing roller and the regulating blade, thereby resulting in aforementioned drawbacks that the toner cannot be uniformly coated on the developing roller or that the charge providing ability of the developing roller and the regulating blade is lowered.

Also, a charge control agent, added to the surface of the toner particles, may be embedded in the interior thereof or peeled off therefrom by such toner softening, whereby the charging ability of the toner itself is lowered and uncharged toner particles are easily generated. As a result, an image defect or a toner scattering is induced.

The above-mentioned drawbacks become conspicuous in the toner having a low fusing temperature and susceptible to heat.

SUMMARY OF THE INVENTION

An object of the present invention is to provide a developing apparatus capable of preventing generation of fused or uncharged developer by a deterioration of the developer.

Another object of the present invention is to provide a developing apparatus capable of stable development over a prolonged period.

Still another object of the present invention is to provide a developing apparatus capable of removing a developer, removed by a developer removing-feeding member, from the developer removing-feeding member.

Still another object of the present invention is to provide a developing apparatus capable of maintaining an appropriate charge on the developer.

Still another object of the present invention is to provide a developing apparatus, in which, even with a developer of a low fusing temperature, the developer is not softened on a developer bearing member or on a developer removing-feeding member.

Still other objects of the present invention, and the features thereof, will become fully apparent from the following detailed description which is to be taken in conjunction with the accompanying drawings.

DESCRIPTION OF THE PREFERRED EMBODIMENTS

In the following, the developing apparatus of the present invention will be explained in detail, with reference to the accompanying drawings.

Embodiment 1

A first embodiment of the present invention will be explained with reference to FIGS. 1 to 4.

Figure 1:
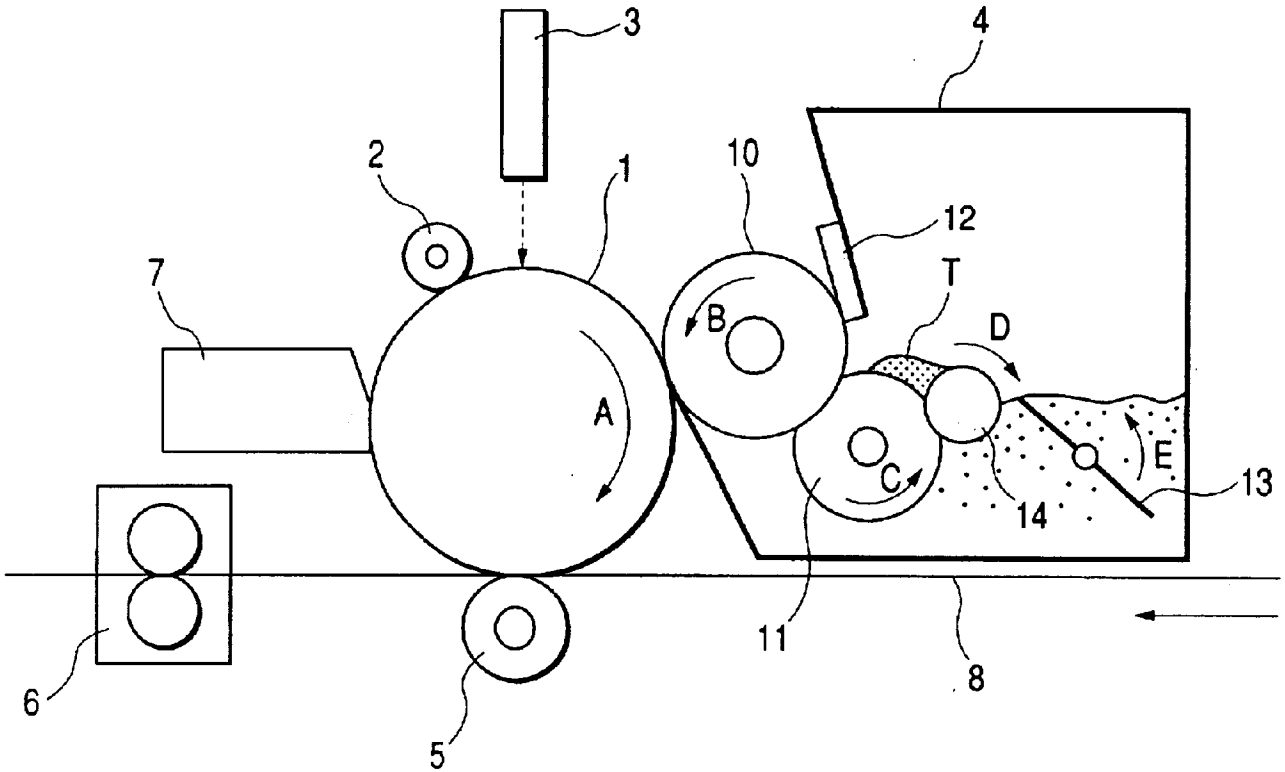
FIG. 1 is a schematic view showing the configuration of an embodiment of an image forming apparatus equipped with a developing apparatus of the present invention.

The image forming apparatus of the present embodiment shown in FIG. 1 is based on a reversal development system in which the developer (toner) visualizes an image deposited onto an image area of the photosensitive drum 1 serving as an image bearing member, thereby obtaining a visible image, and utilizes a one-component development method in which a development is executed by maintaining a developing roller 10, serving as a developer bearing member and bearing negatively charged toner, in contact with a photosensitive drum 1.

The image forming apparatus is provided with a photosensitive drum 1 of a diameter of 40 mm rotated in a direction A shown in FIG. 1, and, around and along the rotating direction of the drum, there are provided in succession a charging device 2, an exposure device 3, a developing device (developing apparatus) 4, a transfer charger 5, and a cleaner 7, and there is also provided a fixing device 6.

In the following there will be given a brief description on an image forming operation in such image forming apparatus.

The photosensitive drum 1, rotating in a direction A with a peripheral speed of 120 mm/sec, is uniformly charged negatively by the charging device 1 connected to an unrepresented bias source. Then the charged surface of the photosensitive drum 1 is exposed for example to a laser light from the exposure device 3, whereby image information is written into the photosensitive drum 1 as an electrostatic latent image.

The developing device 4 is provided with an elastic developing roller 10 rotated in a direction B with a speed of 200 mm/sec, and toner coated thereon is conveyed by the rotation of the developing roller 10 to a contact portion between the photosensitive drum 1 and the developing roller 10, whereby a toner image corresponding to the electrostatic latent image is formed on the photosensitive drum 1, based on a relationship between a DC voltage supplied to the developing roller 10 from an unrepresented bias source and a latent image potential on the photosensitive drum 1.

The transfer charger 5 is positioned opposite to the photosensitive drum 1 across a conveyed transfer material 8 and is connected to a bias voltage power source (not shown). The toner image formed on the photosensitive drum 1 is transferred onto the conveyed transfer material 8, under the application of a voltage of a polarity opposite to that of the toner, to the transfer charger 5 from the bias voltage power source (bias source).

Then the transfer material 8 bearing the transferred toner image is conveyed to the fixing device 6, in which the toner image is heated and fixed by fusion to the transfer material 8.

Residual toner, remaining on the photosensitive drum 1 after the transfer is recovered by the cleaner 7.

An image formation is achieved by repeating the above-described operations.

In the following there will be given a detailed description on configuration and function of the developing device.

The developing device 4 has an aperture extended in the longitudinal direction thereof, in which mounted is an elastic developing roller 10 of a diameter of 20 mm, positioned so as to be in contact with the photosensitive drum 1 and rotated in a direction B with a speed of 200 mm/sec. There are also provided a removing-feeding roller 11 of a diameter of 20 mm (rotated in a direction C with a peripheral speed of 120 mm/sec) constituting a removing-feeding member and being in contact with the developing roller 10, a regulating blade constituting a regulating member being in a pressed contact with the developing roller 10, a circulating roller 14 of a diameter of 6 mm, constituting a circulating member and positioned in contact with the removing-feeding roller 11, and an agitating member 13 (rotated in a direction E) constituting agitating fins for agitating and conveying the toner, and non-magnetic one-component toner is contained in the developing device 4. The circulating roller 14 is rotated, at the contact portion with the removing-feeding roller 11, in a direction (direction D) same as that of the removing-feeding roller 11 at a speed of 120 mm/sec. In the present embodiment, the circulating roller 14 is drive with gears in such a manner that the speed thereof becomes equal to that of the removing-feeding roller 11.

The removing-feeding roller 11 is an elastic member of a diameter of 20 mm, constituted by a metal shaft of a diameter of 8 mm and a continuous-cell foamed member of urethane rubber formed thereon, while the circulating roller 14 is a rigid member of a diameter of 20 mm constituted by a metal such as stainless steel. The developing roller 10 has a push-in amount of 1.5 mm into the removing-feeding roller 11, while the circulating roller 14 has a push-in amount of 1.6 mm into the removing-feeding roller 11. Here, the term of push-in amount of the circulating roller 14 into the removing-feeding roller 11 means an absolute difference between "a distance between the centers" of the removing-feeding roller 11 and the circulating roller 14 and "a sum of radii" thereof. Thus the push-in amount into the removing-feeding roller 11 is larger in the circulating roller 14 than in the developing roller 10. Here, the term of a push-in amount of the developing roller into the removing-feeding roller 11 means an absolute difference between "a distance between the centers" of the removing-feeding roller 11 and the developing roller 10 and "a sum of radii" thereof.

In the developing device 4, the agitating member 13 conveys the toner to the vicinity of the removing-feeding roller 11. The toner conveyed to the vicinity of the removing-feeding roller 11 is conveyed by the rotation thereof to the contact portion between the removing-feeding roller 11 and the developing roller 10, and is supported on the surface thereof. Then, by the rotation of the developing roller 10, the toner thereon is conveyed to a contact portion with the regulating blade 12. In passing such contact portion, the toner is charged negatively by a friction with the regulating blade 12 and the developing roller 10, and is regulated to a uniform layer thickness.

The toner, thus uniformly coated, is conveyed to a contact portion between the photosensitive drum 1 and the developer roller 10 and executes a development on the photosensitive drum 1 in case a latent image is present thereon, but, in case of absence of a latent image, remains on the developing roller 10 and is returned into the developing device 4.

The toner on the developing roller 10, thus returned into the developing device 4, is removed from the developing roller 10 by the removing-feeding roller 11. A major portion of the toner removed from the developing roller 10 is retained in the cells of the removing-feeding roller 11 and is conveyed to the contact portion between the circulating roller 14 and the removing-feeding roller 11.

When the removing-feeding roller 11 enters the contact portion with the circulating roller 14, the removing-feeding roller 11 constituted by an elastic member is deformed, whereby the toner retained in the cells is expelled and drops by gravity into the developing device 4. The toner that has dropped from the removing-feeding roller 11 is mixed and agitated by the agitating member 13 with the toner in the developing device 4.

Also when the removing-feeding roller 11 goes out of the contact portion with the circulating roller 14, the deformed removing-feeding roller 11 restores its original form by an elastic recovering force and toner newly supplied by the agitating member 13 into a toner reservoir T is sucked into the cells and conveyed again to the developing roller 10.

Figure 2:
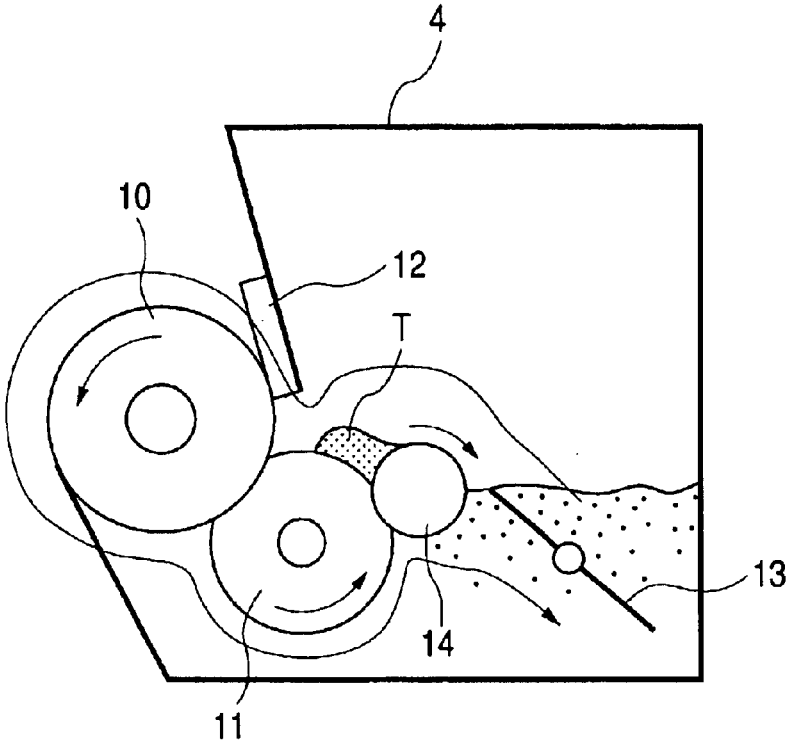
FIG. 2 is a schematic view showing a toner circulating path in the developing apparatus shown in FIG. 1.
Figure 3:
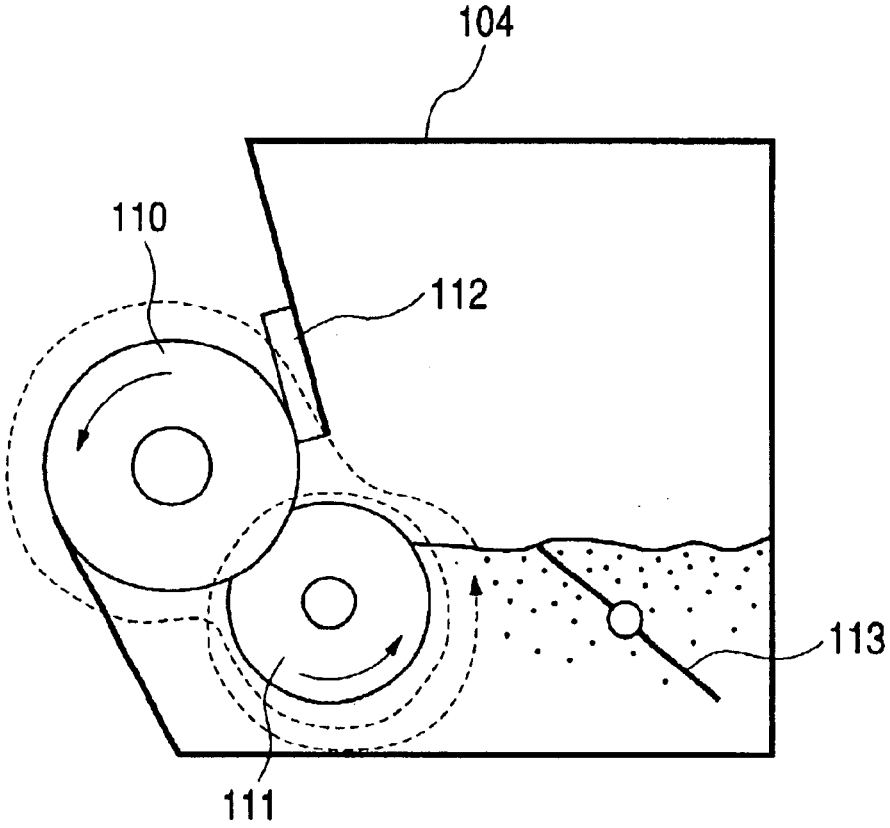
FIG. 3 is a schematic view showing a toner circulating path in a conventional developing apparatus.

FIG. 2 shows such toner flow in the developing device 4.

Such toner circulating path, formed in the developing device 4 as shown in FIG. 2, avoids a continuous passing of the toner through the contact portion between the developing roller 110 and the removing-feeding roller 111 as indicated by a broken line.

As a result, there can be avoided an accumulation of frictional heat in the toner, thereby preventing a fusion to various members resulting from toner softening or a deterioration in the charging ability of the toner. Also since the toner in the removing-feeding roller 11 is replaced every time passing through the contact portion between the removing-feeding roller 11 and the circulating roller 14, there can be prevented generation of an image hysteresis of a preceding cycle like residual image.

Particularly in case the circulating roller 14 and the removing-feeding roller 11 have a same peripheral speed, the toner can be expelled from the cells of the removing-feeding roller 11 without a friction at the entrance of the contact portion. Also as no friction is generated in the course of contact, no frictional heat is generated and the toner can pass through the contact portion without receiving any frictional heat.

Also the toner, present in the toner reservoir T formed by the contact of the removing-feeding roller 11 and the circulating roller 14, is agitated by the rotation of the circulating roller 14 whereby the toner in the toner reservoir T can be maintained in a state of a high fluidity, thereby being prevented from a packing phenomenon and maintained in a state easily sucked by the removing-feeding roller 11. In addition, as the toner can be stored in the toner reservoir T, an image can be printed without causing a deficient image density in comparison with the conventional configuration, even in case the toner amount in the developing device 4 becomes low.

Figure 4:
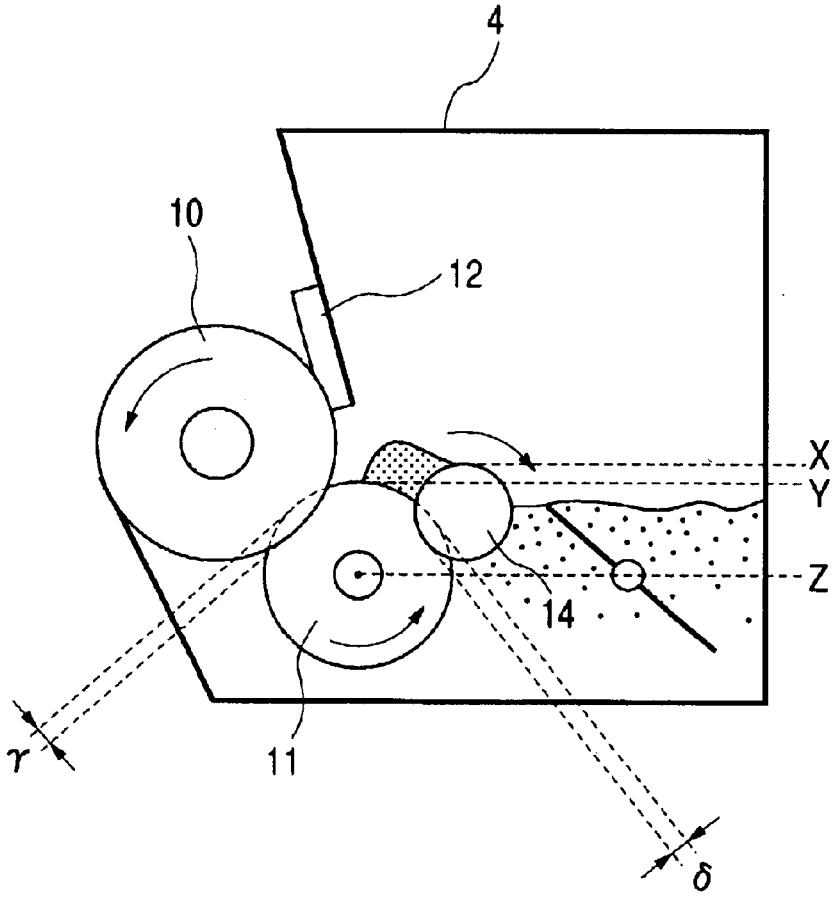
FIG. 4 is a schematic view showing an arrangement of a circulating roller in the developing apparatus shown in FIG. 2.

As the removing-feeding roller 11 and the circulating roller 14 are important constituting factors in the present invention, there will be given a further explanation, with reference to FIG. 4, on the detailed conditions of the removing-feeding roller 11 and the circulating roller 14.

<Positional Relationship of Removing-feeding Roller and Circulating Roller>

The circulating roller 14 is preferably provided in such a manner that an uppermost position x of the circulating roller 14 is vertically above an axial center z of the removing-feeding roller 11, and more preferably in such a manner that the uppermost position x of the circulating roller 14 is above an uppermost position y of the removing-feeding roller 11.

Such arrangement causes the toner, conveyed by the agitating member 13 to an exit of the contact portion between the removing-feeding roller 11 and the circulating roller 14, to be easily stored as a toner reservoir T, whereby the toner of a sufficient amount can be sucked into the cells at the restoration of the removing-feeding roller 11 from deformation. Particularly even in case the toner amount in the developing device 4 becomes low, the toner of a certain amount can be secured in the toner reservoir T so that a stable supply amount can be maintained.

Also the push-in amount $\gamma$ of the developing roller 10 into the removing-feeding roller 11 and the maximum push-in amount $\delta$ of the circulating roller 14 into the removing-feeding roller 11 preferably satisfies a following relation:

$$\gamma \leqq \delta \quad (1)$$

where: $\gamma$ is push-in amount $\gamma$ of the developing roller 10 into the removing-feeding roller 11, and δ is maximum push-in amount of the circulating roller 14 into the removing-feeding roller 11.

The above relation (1) allows to securely expel the undeveloped toner, removed from the developing roller 10, from the removing-feeding roller 11, at the contact portion of the circulating toner and the removing-feeding roller 11, thereby securely preventing that the undeveloped toner is immediately used in the developing process of a next cycle. Preferably there stands a relation:

push-in amount γ<push-in amount δ.

<Hardness>

In order to expel the toner in the cells of the removing-feeding roller 11 at the entrance of the contact portion between the removing-feeding roller 11 and the circulating roller 14, it is at least required that the removing-feeding roller 11 is constituted by a deformable material, and, for more securely expelling the toner, it is preferred that a hardness of the circulating roller 14 is larger than that of the removing-feeding roller 11.

In the present embodiment, the circulating roller 14 is a rigid member formed by stainless steel, while the removing-feeding roller 11 had a hardness of 20 kg/314 $cm^2$ (=63.7 $gf/cm^2 \equiv 6.37\times10^3$ Pa) measured according to Japanese Industrial Standard (JIS) K 6402, so that the circulating roller 14 had a higher hardness.

Also in order to remove the toner on the surface of the developing roller 10 at the contact portion between the developing roller 10 and the removing-feeding roller 11, it is at least required that the removing-feeding roller 11 is constituted by a deformable material, and preferably the developing roller 10 has a hardness larger than that of the removing-feeding roller.

In the present embodiment, the elastic developing roller 10 had a hardness of 40° measured by a JIS-E hardness according to JIS K 6253, while the removing-feeding roller 11 was too soft and the hardness thereof was unmeasurable by this measuring method (measured value almost 0°), so that the elastic developing roller 14 had a higher hardness.

The hardness of the continuous-cell foamed member was measured on a block of 300×300×50 mm, formed with a material same as that of the removing-feeding roller 11.

<Circulating Roller>

In order that the frictional heat, generated in the toner at the toner removal at the contact portion between the developing roller 10 and the removing-feeding roller 11, can be promptly dissipated in the vicinity of such contact portion, the circulating roller 14 is desirably formed by a material of a high thermal conductivity and a low heat capacity, for example a metal (such as stainless steel, aluminum or brass). Preferably, the circulating roller 14 is formed by a material of a higher thermal conductivity and a smaller heat capacity than in the removing-feeding roller 11. Also the circulating roller 14 preferably has a smooth surface in order that the toner expelled from the interior of the removing-feeding roller 11 at the entrance of the contact portion is not drawn into such contact portion by the rotation of the removing-feeding roller 11 or the circulating roller 14 but can be efficiently dropped into the developing device 4.

In order to meet such requirements, the present embodiment employed a circulating roller constituted by stainless steel having a mirror finish.

<Removing-feeding Roller>

In order to minimize the frictional heat generated in the toner at the toner removal in the contact portion between the developing roller 10 and the removing-feeding roller 11, the removing-feeding roller 11 preferably has a hardness of 300 $gf/cm^2$ ($\equiv 3\times10^4$ Pa) or less, measured according to JIS K 6402. Also in order to securely remove and convey the undeveloped toner on the developing roller in such contact portion, there is very preferred a configuration having irregularities on the surface, and a foamed sponge material as employed in the present embodiment can easily satisfy a low hardness and a removing ability. In case the removing-feeding roller 11 is constituted by a foamed member, it preferably has an average cell diameter on the surface thereof of 10 times or more of an average particle size of powder, in order to achieve the removing property and a toner supplying property. In the present embodiment, the toner has an average particle size of 7 μm while the removing-feeding roller has an average cell diameter of 400 μm.

The present embodiment employs, as a deformable removing-feeding roller, a roller constituted by a continuous-cell foamed member, of which a preparing method will be shown in the following.

On a metal core, there is formed an unvulcanized and unfoamed urethane rubber layer in which additives for example a foaming agent and a conductive material such as carbon black are uniformly dispersed. Such members are set and heated in a molding cabinet of a cylindrical mold whereby the unvulcanized and unfoamed rubber layer is foamed and formed in the molding cabinet into a conductive sponge of a shape of the mold. Gas generated in the foaming is discharged through continuous cells formed in the foaming and from a lateral side of the metal mold. In this stage, cells of the continuous-cell sponge, formed on periphery of the metal core have a skin layer, so that the cells are still closed. Finally the surface of the continuous-cell sponge is polished to break such skin layer, whereby a sponge roller of a desired external diameter can be obtained.

In addition, there may also be employed a method of heating an unvulcanized and unfoamed urethane rubber layer in a free state without employing the molding cabinet, and then polishing the surface of the continuous-cell sponge.

Also a sponge roller constituted by plural layers can be prepared by repeating the above-described processes.

A material for the continuous-cell sponge layer in the present invention may employ, for example for the elastic (sponge) layer, urethane rubber, silicone rubber, EPDM rubber, acryl rubber, nitrile rubber, hydrine rubber or fluorinated rubber, but such material is not particularly restricted. A foaming agent can be an inorganic foaming agent such as sodium hydrogencarbonate, sodium carbonate or ammonium carbonate, or an organic foaming agent such as a nitroso compound, an azo compound or a sulfonylhydrazide compound, but is not particularly restricted. Also a conductive material is generally classified into an electronic conductive material and an ionic conductive material, and the electronic conductive material can be for example carbon black or a metal oxide while the ionic conductive material can be for example a quaternary ammonium salt, or an aliphatic alcohol sulfate salt, but such conductive material is not particularly restricted.

The present embodiment employs spherical wax-incorporating toner of an average particle size of 7 μm, prepared by suspension polymerization. Such toner in which wax is incorporated or dispersed in a binder resin is suitable for easily achieving a chargeability of the toner surface and a fixability at a low temperature at the same time. As representative examples, a binder can be a polyester resin or a styrene/acrylic copolymer, while wax can be paraffin wax, olefin wax, ester wax or a higher fatty acid. There may also be employed other materials that are generally employed in the toner preparation. In order to control the chargeability, an external additive such as silica may be added to the surface of the toner, if necessary. The toner employed in the present embodiment was constituted by a binder resin of polyester resin, an incorporated wax of ester wax, and an additive of oil-treated silica.

In the following there will be explained experimental results obtained in printing operations of 10,000 sheets respectively with a developing apparatus of the present embodiment and with a developing apparatus of a conventional configuration. The results are shown in following Table 1, in which:

○: a desired image quality being obtained without any problem;

Δ: toner fusion generated in a part of the developing roller and the removing-feeding roller, whereby a uniform toner coating could not be obtained;

X: fog on photosensitive drum and toner scattering, resulting in a smear on the transfer material.

For the ranks Δ and X, a parenthesized number indicates a number of prints when the drawback was encountered. Also in order to vary the fusing temperature of the toner, the glass transition temperature (Tg) of the toner was changed in six levels.

TABLE 1

| Toner Tg (° C.) | Peripheral speed different of circulating roller to removing-feeding roller (mm/s) | Result of 10,000 prints: First embodiment | Result of 10,000 prints: Conventional configuration |
|---|---|---|---|
| 66 | 0 (rotation at same speed) | ○ | ○ |
| 63 | 0 (rotation at same speed) | ○ | Δ (8500) |
| 60 | 0 (rotation at same speed) | ○ | X (6000) |
| 57 | 0 (rotation at same speed) | ○ | X (4000) |
| 54 | 0 (rotation at same speed) | ○ | X (2000) |
| 51 | 0 (rotation at same speed) | ○ | X (500) |
| 49 | 0 (rotation at same speed) | ○ | X (100) |

In the conventional configuration, no problem was encountered in case the toner had a high glass transition temperature (Tg of 66° C. or higher), but the deterioration of toner, the toner fusion to various member or the image defect, resulting from the frictional heat, occurred at a smaller number of prints as the Tg became lower. On the other hand, in the configuration of the present embodiment having the circulating roller, the desired image quality could be obtained for 10,000 prints without any problem, even in case the toner had a glass transition temperature (Tg) as low as 49° C.

The above-mentioned glass transition temperature (Tg) was measured with a DSC measuring apparatus DSC-7 (manufactured by Perkin Elmer Inc.), according to a method of ASTM D3418-82 as described in the following.

At first, precisely weighed 6 mg of toner were placed in an aluminum pan, and such sample and a reference sample constituted by an empty aluminum pan were subjected to a pre-hysteresis under a condition of a normal temperature and a normal hymidity, by elevating and lowering the temperature at a rate of 4° C./min within a range of 0 to 200° C. Then a heat absorption peak was obtained by elevating the temperature at a rate of 4° C./min. Then the glass transition temperature (Tg) was determined at a crossing point of a line, passing through an intermediate point between base lines before and after the heat absorption peak, and a heat absorption curve.

Glass transition temperatures (Tg) shown in Table 1 were obtained by varying an amount of the wax contained in the toner.

In the developing apparatus of the present embodiment, as explained in the foregoing, a circulating roller is positioned in contact with a removing-feeding roller and is rotated in a same direction and at a same speed as the removing-feeding roller, thereby preventing generation of a frictional heat at the contact portion of both rollers and replacing the toner in the cells of the removing-feeding roller. Thus, even in case of employing a toner having a low fusing temperature and capable of fixation at a low temperature, it is possible to prevent a fusion of the toner or generation of uncharged toner by a toner deterioration, thereby achieving stable development over a prolonged period. Consequently the image forming apparatus of the present embodiment can provide images of a high quality over a prolonged period.

Embodiment 2

In the following, there will be explained, with reference to FIG. 5, a second embodiment of the present invention, wherein components equivalent to those in the foregoing will be represented by same numbers.

Figure 5:
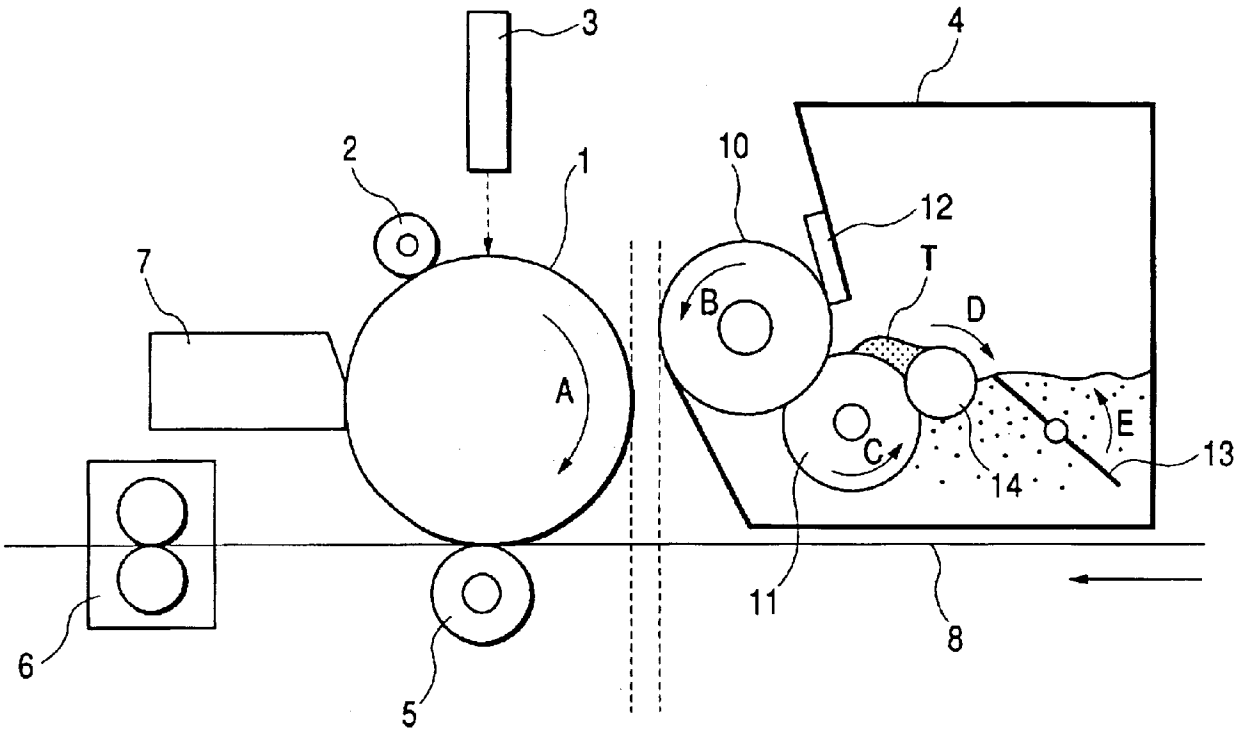
FIG. 5 is a schematic view showing the configuration of another embodiment of the image forming apparatus equipped with the developing apparatus of the present invention.

As shown in FIG. 5, the image forming apparatus of the present embodiment is equipped with a developing apparatus of non-contact type, employing a rigid metal developing roller instead of the elastic developing roller. Components and functions of the image forming apparatus are similar to those in the foregoing first embodiment and will not, therefore, be explained further.

The present embodiment is further featured by a fact that the circulating roller 14 and the removing-feeding roller 11 have a peripheral speed difference.

As in the first embodiment, the toner in the cells of the removing-feeding roller is expelled at the contact portion of the removing-feeding roller 11 and the circulating roller 14 whereby the replacement of the toner can be securely executed. Because of the rotation of the circulating roller 14, the surface of the circulating roller 14 in contact with the removing-feeding roller 11 continuously changes to dissipate the frictional heat, generated at the entrance of the contact portion, through the circulating roller 14 even in case the removing-feeding roller 11 and the circulating roller 14 have a peripheral speed difference as in the present embodiment, whereby the accumulation of the frictional heat in the toner and the toner deterioration can be prevented. Also the toner expelled from the removing-feeding roller 11 at the entrance of the contact portion releases heat while it is returned to and agitated in the developing device 4.

Because of the above-mentioned reasons, even in case the peripheral speed difference between the removing-feeding roller 11 and the circulating roller 14 generates a frictional heat, the frictional heat is less accumulated in the toner than in the conventional configuration, and there can be prevented a fusion of the toner or generation of uncharged toner by a toner deterioration even in case of employing a toner having a low fusing temperature and suitable for low-temperature fixation.

In order to promptly dissipate the frictional heat, generated at the contact portion between the circulating roller 14 and the removing-feeding roller 11, the circulating roller 14 is preferably formed by a material of a high thermal conductivity and a low heat capacity, for example a metal (such as stainless steel, aluminum or brass). Also in order to minimize the frictional heat, generated at the contact portion between the circulating roller 14 and the removing-feeding roller 11, the circulating roller 14 preferably has a surface friction coefficient as small as possible. In order to meet these requirements, the present embodiment employed a circulating roller 14 formed by stainless steel of a mirror surface finish.

Furthermore, in order to minimize the frictional heat at the contact portion of the circulating roller 14 and the removing-feeding roller 11, there is preferred a contact pressure, and a continuous-cell foamed member of a low hardness is optimum for the removing-feeding roller 11.

In the present embodiment, a distance SD between the developing roller 14 and the photosensitive drum 1 was selected as about 300 $\mu$m.

As in the embodiment 1, printing operations of 10,000 prints were executed with the developing apparatuses of the present embodiment and the conventional configuration. Components, other than the developing roller 10, were same as those in the first embodiment. The removing-feeding roller 11 was maintained at a peripheral speed of 120 mm/sec as in the embodiment 1, while the peripheral speed of the circulating roller 14 was regulated with gears so as to obtain a predetermined peripheral speed difference with respect to the removing-feeding roller 11.

Obtained results are shown in following Table 2. In the table, a sign for the peripheral speed difference means a difference of the peripheral speed of the circulating roller 14 with respect to that of the removing-feeding roller 11. For example, a figure +30 mm/sec means that the circulating roller 14 is rotated at 150 mm/sec, and a figure −30 mm/sec means that the circulating roller 14 is rotated at 90 mm/sec. As in the first embodiment, there was employed a wax-incorporating toner, of which the glass transition temperature (Tg) was varied by changing a wax content.

As in the first embodiment, symbols in the table indicate: ○ (Pass): a desired image quality being obtained without any problem; ps Δ: toner fusion generated in a part of the developing roller and the removing-feeding roller, whereby a uniform toner coating could not be obtained;
X (Fail): fog on photosensitive drum and toner scattering, resulting in a smear on the transfer material.

The investigation was executed by changing the peripheral speed of the circulating roller and the glass transition temperature (Tg) of the toner.

TABLE 2

| | Peripheral speed different of | Result of 10,000 prints | |
|---|---|---|---|
| Tg (° C.) | circulating roller to removing-feeding roller (mm/s) | Second embodiment | Conventional configuration |
| 70 | ±120 | ○ | ○ |
| | ±90 | ○ | |
| | ±60 | ○ | |
| 66 | ±120 | ○ | ○ |
| | ±90 | ○ | |
| | ±60 | ○ | |
| 63 | ±120 | ○ | Δ |
| | ±90 | ○ | (8500) |
| | ±60 | ○ | |
| 60 | ±120 | Δ | X |
| | ±100 | ○ | (6000) |
| | ±80 | ○ | |
| | ±60 | ○ | |
| 57 | ±100 | ○ | X |
| | ±80 | ○ | (4000) |
| | ±50 | ○ | |
| | ±30 | ○ | |
| 55 | ±100 | Δ | X |
| | ±80 | ○ | (2500) |
| | ±50 | ○ | |
| | ±30 | ○ | |
| 52 | ±80 | Δ | X |
| | ±50 | ○ | (700) |
| | ±30 | ○ | |
| | ±10 | ○ | |
| 50 | ±70 | Δ | X |
| | ±50 | ○ | (300) |
| | ±30 | ○ | |
| | ±10 | ○ | |

In the conventional configuration, no problem was encountered in case the toner had a high glass transition temperature (Tg of 66° C. or higher), but the deterioration of toner, the toner fusion to various member or the image defect, resulting from the frictional heat, occurred at a smaller number of prints as the Tg became lower.

On the other hand, in the configuration of the present embodiment having the circulating roller 14, the desired image quality could be obtained for 10,000 prints without any problem by preventing rapid toner deterioration, within a range that the peripheral speed difference between the removing-feeding roller 11 and the circulating roller 14 does not exceed ±50 mm/sec, even in case the toner had a glass transition temperature (Tg) as low as 50° C.

Also a desired image could be obtained for 10,000 prints without problem, by maintaining the peripheral speed difference between the removing-feeding roller 11 and the circulating roller 14 within a range of ±50 mm/sec in case the glass transition temperature (Tg) of the toner is 50° C. or higher, also maintaining the peripheral speed difference between the removing-feeding roller 11 and the circulating roller 14 within a range of ±80 mm/sec in case the glass transition temperature (Tg) of the toner is 55° C. or higher, and maintaining the peripheral speed difference between the removing-feeding roller 11 and the circulating roller 14 within a range of ±100 mm/sec in case the glass transition temperature (Tg) of the toner is 60° C. or higher.

In the developing apparatus of the present embodiment, as explained in the foregoing, a peripheral speed difference between the circulating roller the removing-feeding roller is selected within a predetermined range, thereby preventing generation of a frictional heat at the contact portion of both rollers and replacing the toner in the cells of the removing-feeding roller, even in case of employing a toner having a low fusing temperature and capable of fixation at a low temperature, thus achieving stable development over a prolonged period. Consequently the image forming apparatus equipped with such developing apparatus can provide images of a high quality over a prolonged period.

Embodiment 3

Figure 6:
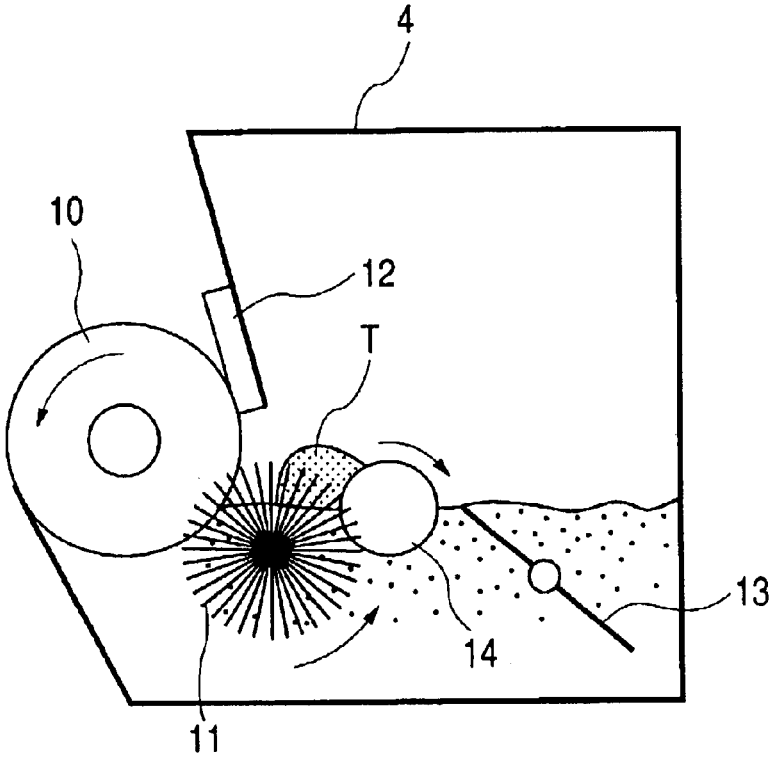
FIG. 6 is a schematic view showing the configuration of another embodiment of the developing apparatus of the present invention.
Figure 7:
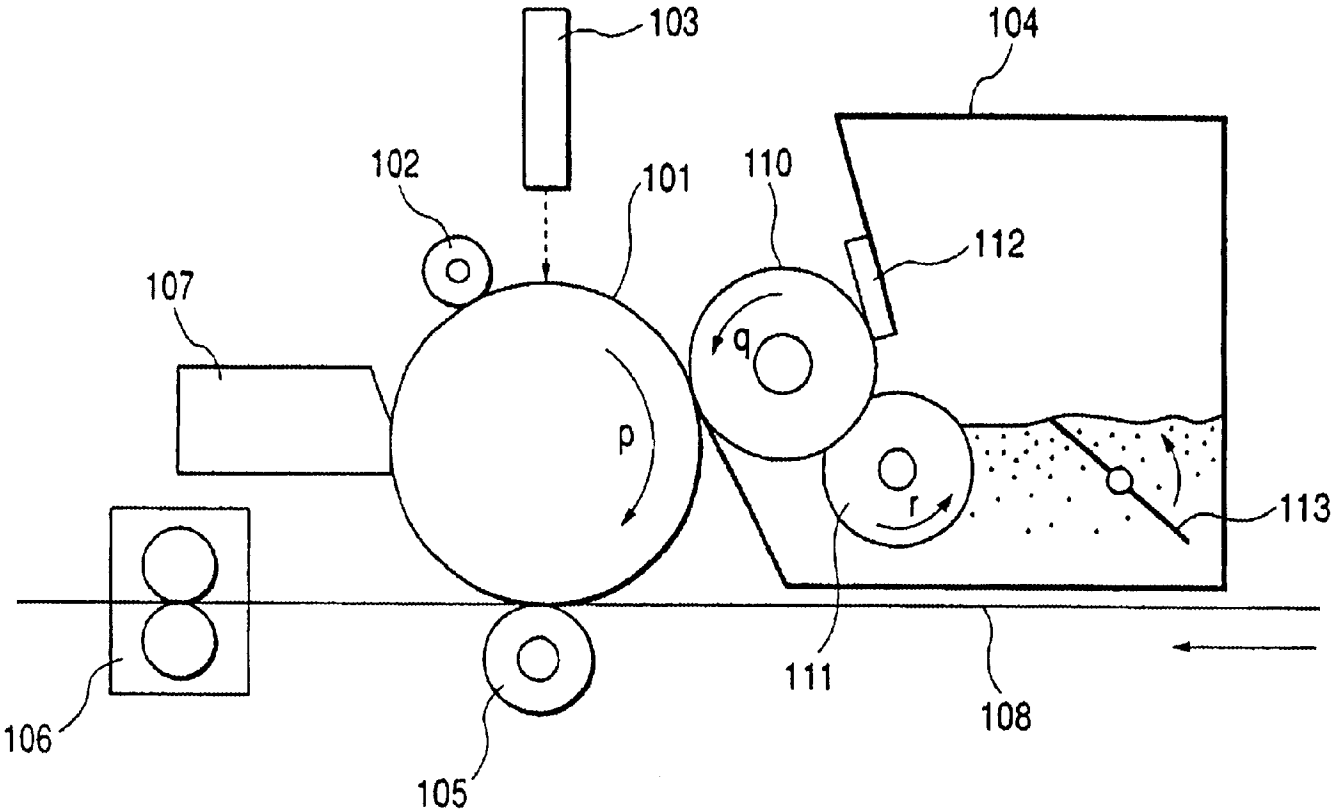
FIG. 7 PRIOR ART
FIG. 7 is a schematic view showing the configuration of an image forming apparatus equipped with a conventional developing apparatus.

In the following, there will be explained, with reference to FIG. 6, a third embodiment of the present invention, wherein components equivalent to those in the foregoing will be represented by same numbers.

The image forming operation in the image forming apparatus of the present embodiment is similar to that in the foregoing first and second embodiments and will not, therefore, be explained further.

The present embodiment is featured by a fact that the removing-feeding roller is replaced by a brush-type of removing-feeding roller. The configuration is substantially same as that of the first embodiment except for such brush-type of removing-feeding roller.

The brush-type of removing-feeding roller 11 is a roller of a diameter of 20 mm, formed by adhering mixed fibers, constituted by nylon fibers and conductive fibers, on a metal shaft of a diameter of 8 mm. It has a rotating direction, as in the first and second embodiments, opposite to that of the developing roller 10 at the contact portion therewith, and the brush-shaped removing-feeding roller 11 is rotated at a peripheral speed of 120 mm/sec. It has a push-in amount of 1.5 mm into the developing roller 10 and 1.6 mm into the circulating roller 14. The fibers of the brush may be formed by a material other than nylon, for example an ordinarily employed material such as acrylic or rayon fibers.

The circulating roller is rotated with a peripheral speed of 120 mm/sec at its outer surface, which is same as the circulating speed of the brush-shaped removing-feeding roller.

Even in case the removing-feeding roller is formed as a brush, it is possible, as in the case of the continuous-cell foamed member, to expel the toner, held in the gaps between the fibers, from such gaps at the entrance of the contact portion with the circulating roller 14. It is also possible, at the elastic restoration of the brush at the exit of the contact portion of both rollers, to draw the toner, supplied by the agitating member 13, into the gaps of the fibers. As a result, it is possible to prevent continuous passing of the toner through the contact portion of the developing roller 10 and the removing-feeding roller 11 and to prevent an accumulation of frictional heat in the toner, thereby preventing a fusion to various members resulting from toner softening or a deterioration in the charging ability of the toner.

Also as in the first and second embodiments, because of the rotation of the circulating roller 14, the surface of the circulating roller 14 in contact with the removing-feeding roller 11 continuously changes to dissipate the frictional heat, accumulated in the toner at the toner removal at the contact portion between the developing roller 10 and the removing-feeding roller 14. Also at the exit of the contact portion, the toner conveyed by the agitating member 13 to the toner reservoir T can be agitated by the rotation of the circulating roller 14, and the toner in the toner reservoir T can be constantly replaced by the removing-feeding roller 14.

A printing operation of 10,000 prints was executed with the above-described developing apparatus as in the first and second embodiments. Components and toner were same as those in the first embodiment, except for the removing-feeding roller.

Obtained results were similar to those in the first embodiment, the image could be obtained for 10,000 prints without any problem, even in case the toner had a glass transition temperature (Tg) as low as 50° C. On the other hand, a configuration without the circulating roller (a conventional configuration in which the removing-feeding roller was replaced by a brush-shaped removing-feeding roller) resulted a toner deterioration, toner fusion to various components and an image defect by the frictional heat, in case the toner had a glass transition temperature (Tg) of 60° C. or less.

Also with a peripheral speed difference between the removing-feeding roller 11 and the circulating roller 14, the rapid toner deterioration could be prevented and the desired image can be obtained for 10,000 prints without problem even in case the toner had a glass transition temperature (Tg) as low as 50° C., at the peripheral speed difference between the removing-feeding roller 11 and the circulating roller 14 within a range of ±50 mm/sec.

Further, a desired image could be obtained for 10,000 prints without problem, at the peripheral speed difference between the removing-feeding roller 11 and the circulating roller 14 within a range of ±50 mm/sec in case the glass transition temperature (Tg) of the toner is 50° C. or higher, also maintaining the peripheral speed difference between the removing-feeding roller 11 and the circulating roller 14 within a range of ±80 mm/sec in case the glass transition temperature (Tg) of the toner is 55° C. or higher, and maintaining the peripheral speed difference between the removing-feeding roller 11 and the circulating roller 14 within a range of ±100 mm/sec in case the glass transition temperature (Tg) of the toner is 60° C. or higher.

As explained in the foregoing, also in case the removing-feeding roller is a brush type (brush shape), by maintaining and rotating the circulating roller in contact with the removing-feeding roller, there can be provided a developing apparatus capable of preventing continuous passing of the toner through the contact portion of the developing roller and the removing-feeding roller and avoiding toner deterioration, thereby enabling stable development over a prolonged period. Consequently an image forming apparatus equipped with such developing apparatus can provide images of a high quality over a prolonged period.

In the foregoing embodiments, the circulating roller is driven with gears regardless of the peripheral speed thereof, but, in case it is rotated at a speed same as that of the removing-feeding roller, it may be driven by the removing-feeding roller.

Also in the foregoing embodiments, there has been explained a configuration in which a continuous-cell foamed member has been employed in the removing-feeding roller, but it is possible, also in case of an isolated-cell foamed member, to replace the toner in the surface cells without applying unnecessary pressure or frictional force on the toner.

Also in the foregoing embodiments, there has been explained a case of employing non-magnetic one-component negatively charged toner, but such configuration is not restrictive and similar effects can be obtained also with a magnetic toner or a positive charged toner.

Also in the foregoing embodiments, there has been explained a negative reversal development system as an example, but similar effects can also be obtained in a reversal/normal development system or in a contact/non-contact development system.

In the development apparatus of the present invention, as explained in the foregoing, a rotatable circulating member, having a hardness higher than that of a removing-feeding member, is positioned in contact therewith and is given a push-in amount to the removing-feeding member, larger than a push-in amount of a developer bearing member, thereby preventing a fusion of the developer or generation of an uncharged developer resulting from deterioration thereof, even with a developer having a low fusing temperature and capable of low-temperature fixation. Consequently a stable development can be realized over a prolonged period, and images of a high quality can be obtained over a prolonged period.

In particular, by rotating the circulating member in a same direction and at a same speed, it is possible to replace the developer in the cells of the removing-feeding member without applying unnecessary pressure or frictional force to the developer, thus without providing the developer with a frictional heat at the contact portion, whereby the deterioration of the developer can be securely prevented even in case of employing a developer of a low fusing temperature, capable of low-temperature fixation.

Also in case the circulating member and the removing-feeding member have a peripheral speed difference, by maintaining such peripheral speed difference within a predetermined range, it is possible to prevent accumulation of frictional heat at the contact portion into the developer, even in case of employing a developer of a low fusing temperature, capable of low-temperature fixation.

What is claimed is:

1. A developing apparatus comprising:

a developer bearing member for bearing developer;

a developer removing-feeding member in contact with said developer bearing member, for feeding the developer to said developer bearing member and removing the developer from said developer bearing member; and a developer circulating member in contact with said developer removing-feeding member, for feeding the developer to said developer removing-feeding member and removing the developer from said developer removing-feeding member, said developer circulating member having a hardness larger than that of said developer removing-feeding member, wherein said developer circulating member has a push-in amount into said developer removing-feeding member, which is larger than a push-in amount of said developer bearing member into said developer removing-feeding member.

2. A developing apparatus according to claim 1, wherein said developer bearing member and said developer removing-feeding member are rotatable.

3. A developing apparatus according to claim 2, wherein said developer circulating member is rotatable.

4. A developing apparatus according to claim 3, wherein said developer circulating member rotates in a forward direction with respect to said developer removing-feeding member, in a contact portion of said developer circulating member and said developer removing-feeding member.

5. A developing apparatus according to claim 4, wherein said developer circulating member has a peripheral speed, which is a same speed as a peripheral speed of said developer removing-feeding member.

6. A developing apparatus according to claim 1, wherein said developer removing-feeding member includes an elastic foamed member formed on a surface thereof.

7. A developing apparatus according to claim 3, wherein an uppermost point of said developer circulating member is positioned above a rotation center of said developer removing-feeding member.

8. A developing apparatus according to claim 3, wherein said developer has a glass transition temperature of 60° C. or higher, and said developer circulating member and said developer removing-feeding member have a peripheral speed difference of ±100 mm/sec or less.

9. A developing apparatus according to claim 3, wherein said developer has a glass transition temperature of 55° C. or higher, and said developer circulating member and said developer removing-feeding member have a peripheral speed difference of ±80 mm/sec or less.

10. A developing apparatus according to claim 3, wherein said developer has a glass transition temperature of 50° C. or higher, and said developer circulating member and said developer removing-feeding member has a peripheral speed difference of ±50 mm/sec or less.

11. A developing apparatus according to claim 1, wherein said developer bearing member develops an electrostatic image forming on an image bearing member with the developer.

* * * * *

UNITED STATES PATENT AND TRADEMARK OFFICE

CERTIFICATE OF CORRECTION

PATENT NO. : 6,829,464 B2
DATED : December 7, 2004
INVENTOR(S) : Manami Haraguchi et al.

It is certified that error appears in the above-identified patent and that said Letters Patent is hereby corrected as shown below:

Title page,
Item [56], References Cited, FOREIGN PATENT DOCUMENTS,
"10153910" should read -- 10-153910 --.

Column 4,
Line 49, "transfer" should read -- transfer, --.

Column 7,
Line 24, "gf/cm$^2$≡6.37×10$^3$ Pa)" should read -- gf/cm$^2$ ≅ 6.37×10$^3$ Pa) --.

Column 9,
Line 57, "hymidity," should read -- humidity, --.

Column 11,
Line 31, "ps Δ: toner" should read -- Δ: toner --.

Column 13,
Line 51, "resulted" should read -- resulted in --.

Column 16,
Line 26, "has" should read -- have --.

Signed and Sealed this

Seventeenth Day of May, 2005

JON W. DUDAS
*Director of the United States Patent and Trademark Office*